United States Patent [19]

Sampietro

[11] 4,145,839

[45] Mar. 27, 1979

[54] ILLUMINATED FLIGHT TOY

[76] Inventor: Joseph M. Sampietro, 6334 Arizona Pl., Tarzana, Calif. 90045

[21] Appl. No.: 761,117

[22] Filed: Jan. 21, 1977

[51] Int. Cl.[2] ..... A63H 27/00; A63H 33/26

[52] U.S. Cl. ..... 46/228; 46/74 D

[58] Field of Search ..... 46/74 D, 228; 240/10.68

[56] References Cited

U.S. PATENT DOCUMENTS

| | | | |
|---|---|---|---|
| 3,798,834 | 3/1974 | Samuel | 46/74 D |
| 3,971,158 | 7/1976 | Hanson | 46/228 |
| 4,044,499 | 8/1977 | Toler | 46/228 |

*Primary Examiner*—Louis G. Mancene
*Assistant Examiner*—Robert F. Cutting
*Attorney, Agent, or Firm*—Lyon & Lyon

[57] ABSTRACT

Disclosed herein is a disc-shaped directional-flight toy having at least one centrifugally actuated lighting assembly mounted thereon for energizing a lamp during flight. The lighting assembly is disposed in a molded cavity adjacent the rim of the toy and includes the lamp and a battery disposed in axial alignment with the lamp and a coil spring extending therebetween.

10 Claims, 6 Drawing Figures

FIG. 1
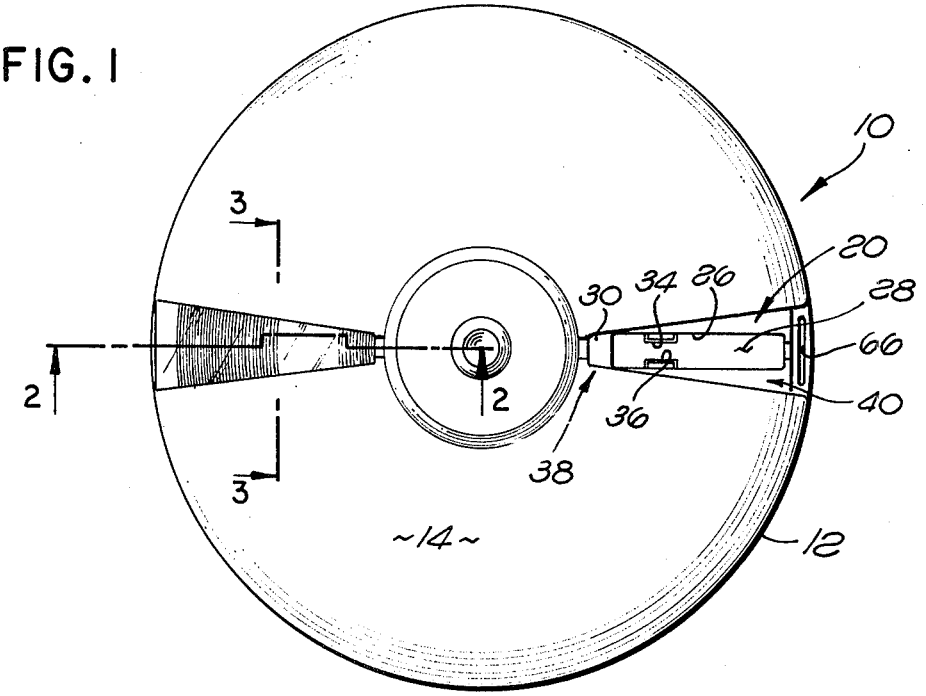
FIG. 2
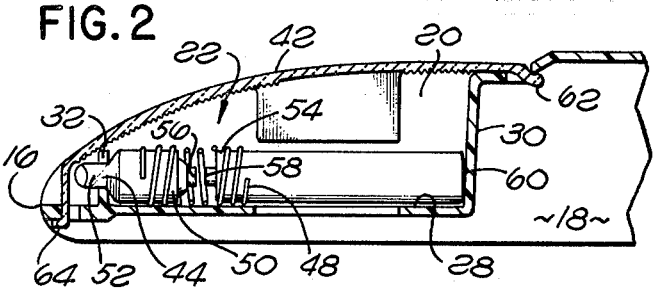
FIG. 3
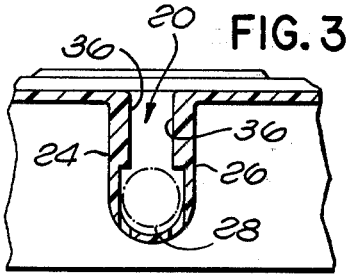
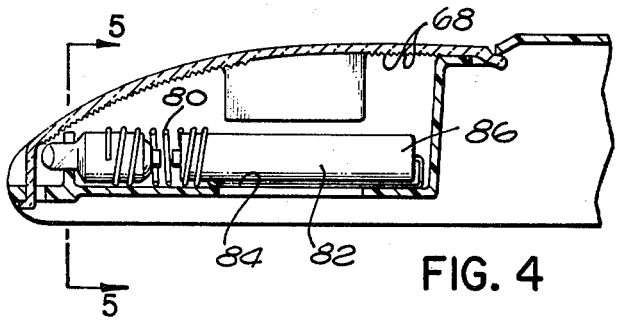
FIG. 4
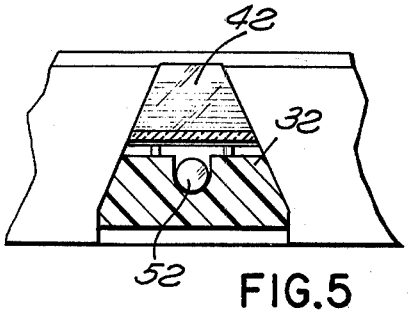
FIG. 5
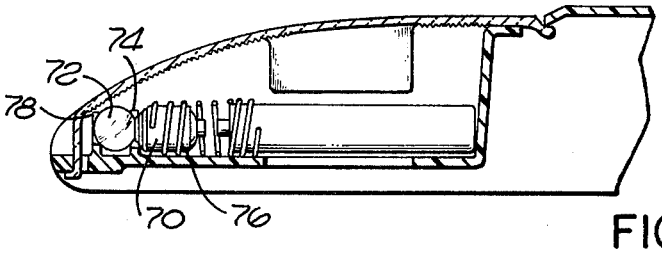
FIG. 6

ILLUMINATED FLIGHT TOY

BACKGROUND OF THE INVENTION

The present invention relates to an illuminated disc-shaped directional-flight toy. Among the more popular of the present day outdoor toys is the "flying saucer" or "Frisbee," the latter being a trademark of the Wham-O Mfg. Co. of San Gabriel, Calif. The flying saucer has a light-weight plastic disc-shaped body which is typically about 9 inches in diameter and 1½ inches deep and terminates at its periphery in a downwardly pointing rim so that the body and rim define a generally convex upper surface and a generally concave lower surface. In use, the flying saucer is thrown back and forth in a well-known manner where spinning gyroscopic motion is imparted by the thrower to the flying saucer allowing the flying saucer to be sailed over great distances in controlled flight.

While the flying saucer has met with tremendous popularity on the beaches, parks and other open spaces, its use is generally limited to the daylight hours. It would therefore be highly desirable to provide a flying saucer which could be illuminated for night time use without substantially affecting the aerodynamic qualities of the flying saucer.

SUMMARY OF THE INVENTION

Briefly, the present invention comprises a disc-shaped directional-flight toy having a plurality of lamps mounted near the rim portion thereof which are energized by the centrifugal force generated by the rotational flight of the toy urging a corresponding plurality of batteries into electrical contact with each of the lamps, thereby providing illumination at the rim of the flying saucer and making the saucer suitable for night play.

It is the principal object of the present invention to provide an improved flying saucer that is suitable for night use.

This and other objects and advantages of the present invention will become apparent from the following detailed description taken in conjunction with the accompanying drawings.

DESCRIPTION OF THE PREFERRED EMBODIMENT

FIG. 1 is a plan view of the disc-shaped directional-flight toy of the present invention.

FIG. 2 is a sectional view taken through lines 2—2 of FIG. 1.

FIG. 3 is a sectional view taken along line 3—3 of FIG. 1.

FIG. 4 is a sectional view illustrating an alternate embodiment of the coil spring.

FIG. 5 is a sectional view taken along line 5—5 of FIG. 4.

FIG. 6 is a sectional view illustrating an alternate embodiment of the light bulb support member.

Referring now in detail to the drawings, the flying saucer 10 of the present invention comprises a body member 12 preferably constructed of a thermosetting plastic material such as polypropylene or polyethylene, having a generally convex outer surface 14 terminating in a rounded peripheral rim portion 16 about an open generally concave area 18 and defining a plurality of elongated chambers 20 therein. The chambers 20 house the lighting assemblies 22. While the number of such chambers and assemblies is not critical, for proper weight distribution at least two such chambers and assemblies should be provided and they should be equally spaced about the flying saucer 10. The two chambers 20 shown in the drawings are integrally molded with the body member 12 of the flying saucer and each comprise a pair of side walls 24 and 26, a bottom support surface 28, back wall 30, a forward U-shaped support member 32 disposed adjacent the extended end of the chamber and a pair of positioning stops 34 and 36 protruding inwardly of the chamber from each of the side walls 24 and 26. Each chamber 20 is opened at its upper end 38 and extended end 40 to accommodate the installation of a lighting assembly 22 and outer lense 42.

A lighting assembly 22 is comprised of a lamp 44, an axially aligned battery 46 and a coil spring 48 extending therebetween. In the embodiment of the invention illustrated in FIGS. 1 through 3, the lamp 44 has a threaded base portion 50 and a protruding bulb portion 52. By way of example, a General Electric No. 112 bulb is well-suited for this purpose due to its configuration and durability and the illustrated battery 46 is non-alkaline size AAA. The spring member 48 has right handed coils, an inside diameter of about 0.325 inches and a spring rate of about 1.5 to 2.5 pounds per inch. One end of the spring member 48 is threaded onto the base portion 50 of the lamp 44 and the other end on to the forward portion 54 of the battery, under any insulating material thereon, leaving a spacing of about 0.06 inches between the electrical contact 56 on the lamp 44 and the electrical contact 58 on the battery 46.

The lighting assembly 22 is disposed within the chamber 20 resting on the support surface 28 thereof with the rear end 60 of the battery abutting the rear wall 30 of the chamber and the protruding bulb portion 52 of the lamp 44 extending through and abutting the U-shaped support 32 at the extended end of the chamber 20 as illustrated in FIGS. 2 and 5. The battery positioning stops 34 and 36 extending inwardly of the chamber from the side walls 24 and 26 thereof over the battery 46 and together with the rear wall 30 of the chamber and the U-shaped support member 32 secure the lighting assembly 22 in place within chamber 20.

The lense 42 has a narrow tab 62 at the inner end thereof which is adapted to fit under a portion of the housing adjacent the inner end of chamber 20. A larger tab 64 is disposed at the external end of the lense which is adapted to extend through an elongated slot 66 transversely disposed in the extended end of the support surface 28 of the chamber 20 by which the lense 42 is secured to the body portion 12 of the flying saucer 10 over the open chamber 20. The lense is preferably constructed of a transparent acrylic material and is provided with a plurality of ridges 68 transversely disposed across the interior side thereof to provide a Fresnel-type lense whereby the light emanating from the lamp 44 is dispersed over the entire area of the lense 42. Alternatively, a frosted lense could be employed in lieu of the transparent lense and ridges 68.

In use, when the flying saucer 10 is thrown in the conventional manner such that it undergoes spinning gyroscopic motion, the batteries are moved outwardly by the centrifugal force created by such motion, overcoming the force of the spring members 48 and coming into electrical contact with the lamps 44 thereby activating the lamps and illuminating the flying saucer through lenses 42. In this construction, the spring members 48 serve to restrain the batteries 46 in the desired spaced disposition with respect to the lamps 44, control the rate of acceleration of the batteries and acts as a current carrier. By providing the spring members 48 with right handed coils as opposed to the conventional left handed coils, the springs can be easily threaded onto the batteries under the insulating material thereon to grip the battery and make the necessary electrical contact therewith.

An alternate embodiment of the invention is illustrated in FIG. 6 wherein the lamp 44 is replaced with a lamp 70 having a cylindrical bulb portion 72. In this embodiment, the U-shaped support 32 of the prior embodiment is replaced with an enlarged U-shaped support 74 disposed between the cylindrical bulb portion 72 of the lamp 70 and the threaded base portion 76 thereof and a forward stop member 78 is provided adjacent the forward extended end of the bulb portion thereby securing the lamp 70 in place within the chamber 20.

A third embodiment of the invention is illustrated in FIG. 4 wherein the spring 80 is adapted for use with an alkaline battery 82. Because the spring member 48 of the prior embodiment cannot make electrical contact with the sidewalls of an alkaline battery, the spring member 80 is provided with an extension 84 which contacts the rearward end 86 of the alkaline battery for making the necessary contact. the coiled position of the spring member 80 provides the same mechanical functions as does spring member 48 in the prior embodiments of the invention.

Various changes and modifications may be made in carrying out the present invention without departing from the spirit and scope thereof. Insofar as these changes and modifications are within the purview of the appended claims, they are to be considered as part of the present invention.

I claim:

1. A disc-shaped, directional flight toy comprising a generally saucer shaped body member having a central axis about which said member is adapted to rotate in sustained flight, a plurality of elongated open chambers equiangularly disposed about said body member, each of said chambers extending radially outwardly from said axis, being adapted to receive a battery slidably mounted therein and include a back wall support, a bottom wall support and a forward bulb support extending into said chamber from said bottom wall support, a plurality of battery powered light bulbs, at least a portion of one of said bulbs being disposed in each of said chambers, and a plurality of spring members, one of said members being disposed in each of said chambers, secured to and in electrical contact with each of said bulbs and being adpated to be secured to a battery slidably mounted in each of said chambers such that the battery would be carried by said spring member in electrical contact and radial alignment therewith and spaced from said bulb by said spring member a distance such that upon rotational movement about said axis being imparted to said body member, centrifugal force causes the battery so positioned to move radially outwardly compressing said spring member and coming into contact with said bulb thereby completing an electrical circuit and energizing said bulb.

2. The combination of claim 1 wherein each of said spring members comprise a right-handed coil spring whereby each of said members can be threadably engaged with one of said bulbs and rotated onto a battery under a layer of protective insulating material, electrically coupling the said bulb to a battery while axially aligning the bulb and battery within one of said chambers.

3. The combination of claim 1 wherein each of said chambers are open at the upper end thereof and include a back wall support, a bottom wall support and a forward bulb support extending into said chamber from said bottom wall support such that upon securing said spring member to said bulb and a battery, said spring member, bulb and battery are held in radial alignment within said chamber.

4. The combination of claim 3 wherein said forward bulb support is spaced from said wall support a distance such that upon securing said spring member to said bulb and a battery, the contact end of said battery is spaced about 0.06 inches from the contact end of said bulb.

5. The combination of claim 4 wherein said spring means has a spring rate of about 1.5 to 2.5 pounds per inch.

6. A disc-shaped, directional-flight toy comprising a generally saucer-shaped body member having a central axis about which said member is adapted to rotate in sustained flight, a plurality of elongated chambers equiangularly disposed about said body member and extending radially outwardly from said axis, a plurality of batteries, one of said batteries being slidably disposed in each of said chambers, a plurality of battery powered light bulbs, at least a portion of one of said bulbs being disposed in each of said chambers, and a plurality of spring members, one of said members being disposed in each of said chambers and being secured to and in electrical contact with one of said bulbs and one of said batteries such that said bulb and said battery are carried by said spring member and are electrically coupled and spaced apart in axial alignment by said spring member such that upon rotational movement about said axis being imparted to said body member, centrifugal force causes said battery to move outwardly compressing said spring and coming into contact with said bulb thereby completing an electrical circuit and energizing said bulb.

7. The combination of claim 6 wherein each of said spring members comprise a right-handed coil spring whereby each of said members can be threadably engaged with one of said bulbs and rotated onto a battery under the layer of protective insulating material, electrically coupling the said bulb to a battery while axially aligning the bulb and battery within one of said chambers.

8. The combination of claim 6 wherein each of said chambers are open at the upper end thereof and include a back wall support, a bottom wall support and a forward bulb support extending into said chamber from said bottom wall support such that upon securing said spring member to said bulb and a battery, said spring member, bulb and battery are held in radial alignment within said chamber.

9. The combination of claim 8 wherein said forward bulb support is spaced from said wall support a distance such that upon securing said spring member to said bulb and a battery, the contact end of said battery is spaced about 0.06 inches from the contact end of said bulb.

10. The combination of claim 9 wherein said spring means has a spring rate of about 1.5 to 2.5 pounds per inch.

* * * * *